US011562687B2

(12) United States Patent
Park et al.

(10) Patent No.: US 11,562,687 B2
(45) Date of Patent: Jan. 24, 2023

(54) PIXEL AND DISPLAY APPARATUS HAVING THE SAME

(71) Applicant: Samsung Display Co., Ltd., Yongin-Si (KR)

(72) Inventors: Junhyun Park, Suwon-si (KR); Seon Young Choi, Gunpo-si (KR); Sunhwa Lee, Yongin-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 17/532,220

(22) Filed: Nov. 22, 2021

(65) Prior Publication Data

US 2022/0284850 A1 Sep. 8, 2022

(30) Foreign Application Priority Data

Mar. 4, 2021 (KR) ..... 10-2021-0029086

(51) Int. Cl.
*G09G 3/32* (2016.01)

(52) U.S. Cl.
CPC ..... *G09G 3/32* (2013.01); *G09G 2300/0842* (2013.01); *G09G 2310/0267* (2013.01); *G09G 2310/08* (2013.01)

(58) Field of Classification Search
CPC ..... G09G 3/32; G09G 2300/0842; G09G 2310/0267; G09G 2310/08
See application file for complete search history.

(56) References Cited

U.S. PATENT DOCUMENTS

| | | | | |
|---|---|---|---|---|
| 2016/0351160 | A1* | 12/2016 | In | G09G 3/3225 |
| 2017/0061914 | A1* | 3/2017 | Park | G09G 3/20 |
| 2018/0366066 | A1* | 12/2018 | Kim | H01L 27/3265 |
| 2019/0066598 | A1* | 2/2019 | Kim | G09G 3/3258 |
| 2019/0139617 | A1* | 5/2019 | Sasaki | G09G 3/3677 |
| 2019/0245126 | A1* | 8/2019 | Lim | H01L 33/36 |
| 2020/0380911 | A1* | 12/2020 | Park | G09G 3/32 |
| 2020/0394968 | A1* | 12/2020 | Kwon | G09G 3/3291 |
| 2021/0366408 | A1* | 11/2021 | In | G09G 3/3266 |

FOREIGN PATENT DOCUMENTS

| | | | |
|---|---|---|---|
| KR | 101329964 | B1 | 11/2013 |
| KR | 101351416 | B1 | 1/2014 |
| KR | 1020160052942 | A | 5/2016 |
| KR | 102045546 | B1 | 12/2019 |

* cited by examiner

*Primary Examiner* — Andrew Sasinowski
(74) *Attorney, Agent, or Firm* — Cantor Colburn LLP

(57) ABSTRACT

A pixel includes a light emitting element, a data write switching element, a driving switching element, a light emitting element initialization switching element and a boosting capacitor. The data write switching element is configured to receive a data voltage from the outside. The driving switching element is configured to apply a driving current to the light emitting element based on the data voltage. The light emitting element initialization switching element is configured to apply an initialization voltage to a first electrode of the light emitting element. The boosting capacitor includes a first electrode connected to a control electrode of the light emitting element initialization switching element and a second electrode connected to an output electrode of the data write switching element.

20 Claims, 16 Drawing Sheets

| Cboost | AFTER T1 GATE WRITING | T1 GATE EB BOOSTING | CHANGE AMOUNT OF T1 @BOOSTING |
|---|---|---|---|
| 10f | 0.409 | -0.458 | -0.867 |
| 20f | 0.408 | -1.2 | -1.608 |
| 30f | 0.406 | -1.85 | -2.256 |
| 40f | 0.405 | -2.41 | -2.815 |
| 50f | 0.403 | -2.91 | -3.313 |

| Cboost | AFTER T1 GATE WRITING | T1 GATE EB BOOSTING | CHANGE AMOUNT OF T1 @BOOSTING |
|---|---|---|---|
| 5f | 0.444 | -0.445 | -0.889 |
| 10f | 0.473 | -1.21 | -1.683 |
| 15f | 0.499 | -1.9 | -2.399 |
| 20f | 0.523 | -2.53 | -3.053 |
| 25f | 0.544 | -3.09 | -3.634 |
| 30f | 0.564 | -3.6 | -4.164 |

PIXEL AND DISPLAY APPARATUS HAVING THE SAME

This application claims priority to Korean Patent Application No. 10-2021-0029086, filed on Mar. 4, 2021, and all the benefits accruing therefrom under 35 U.S.C. § 119, the content of which in its entirety is herein incorporated by reference.

BACKGROUND

1. Field

Embodiments of the present invention relate to a pixel and a display apparatus including the pixel. More particularly, embodiments of the present invention relate to a pixel operating a bias operation of a driving switching element using a boosting capacitor in a display apparatus supporting a variable frequency and a display apparatus including the pixel.

2. Description of the Related Art

Generally, a display apparatus includes a display panel and a display panel driver. The display panel includes a plurality of gate lines, a plurality of data lines, a plurality of emission lines and a plurality of pixels. The display panel driver includes a gate driver, a data driver, an emission driver and a driving controller. The gate driver outputs gate signals to the gate lines. The data driver outputs data voltages to the data lines. The emission driver outputs emission signals to the emission lines. The driving controller controls the gate driver, the data driver and the emission driver.

SUMMARY

In a display apparatus supporting a variable frequency, a bias operation of a driving switching element may be operated to enhance a hysteresis characteristic of the driving switching element. When an additional gate driver and an additional switching element are formed to operate the bias operation of the driving switching element, a high resolution integration of the display panel may be difficult due to the additional switching elements and additional horizontal wirings.

Embodiments of the present invention provide a pixel capable of operating a bias operation of a driving switching element using a boosting capacitor.

Embodiments of the present invention also provide a display apparatus including the pixel.

In an embodiment of a pixel according to the present invention, the pixel includes a light emitting element, a data write switching element, a driving switching element, a light emitting element initialization switching element and a boosting capacitor. The data write switching element is configured to receive a data voltage from the outside. The driving switching element is configured to apply a driving current to the light emitting element based on the data voltage. The light emitting element initialization switching element is configured to apply an initialization voltage to a first electrode of the light emitting element. The boosting capacitor includes a first electrode connected to a control electrode of the light emitting element initialization switching element and a second electrode connected to an output electrode of the data write switching element.

In an embodiment, the pixel may further include: a first transistor including a control electrode connected to a first node, an input electrode connected to a second node and an output electrode connected to a third node; a second transistor including a control electrode which receives a data write gate signal, an input electrode which receives the data voltage and an output electrode connected to a fourth node; a third transistor including a control electrode which receives a compensation gate signal, an input electrode connected to the first node and an output electrode connected to the third node; a fourth transistor including a control electrode which receives a data initialization gate signal, an input electrode which receives the initialization voltage and an output electrode connected to the first node; a fifth transistor including a control electrode which receives the compensation gate signal, an input electrode which receives a reference voltage and an output electrode connected to the fourth node; a sixth transistor including a control electrode which receives an emission signal, an input electrode connected to the third node and an output electrode connected to an anode electrode of the light emitting element; and a seventh transistor including a control electrode which receives a light emitting element initialization gate signal, an input electrode which receives the initialization voltage and an output electrode connected to the anode electrode of the light emitting element. The driving switching element may be the first transistor, the data write switching element may be the second transistor, and the light emitting element initialization switching element may be the seventh transistor.

In an embodiment, the pixel may further include: a storage capacitor including a first electrode connected to the first node and a second electrode connected to the fourth node; and a hold capacitor including a first electrode which receives a high power voltage and a second electrode connected to the fourth node.

In an embodiment, when a voltage change amount of the control electrode of the first transistor is ΔVGT1 where a voltage of the control electrode is changed by the boosting capacitor in a bias period, a capacitance of the storage capacitor is CST, a capacitance of the hold capacitor is CHOLD, a capacitance of the boosting capacitor is CBOOST, a capacitance of the first transistor T1 is CGT1, a high level of the light emitting element initialization gate signal is VGH and a low level of the light emitting element initialization gate signal is VGL, the voltage change amount may be determined by following Equation:

$$\Delta VGT1 = \frac{CBOOST}{CST + (CHOLD \,//\, CGT1) + CBOOST} \times (VGH - VGL),$$

// means a parallel connection of capacitances.

In an embodiment, the data write gate signal may have an inactive level in a bias period. The compensation gate signal may have an inactive level in the bias period. The data initialization gate signal may have an inactive level in the bias period. The light emitting element initialization gate signal may have an active level in the bias period.

In an embodiment, the data write gate signal may maintain the inactive level in the bias period. The compensation gate signal may maintain the inactive level in the bias period. The data initialization gate signal may maintain the inactive level in the bias period. The light emitting element initialization gate signal may have a plurality of pulses having the active level in the bias period.

In an embodiment, the pixel may further include an eighth transistor including a control electrode which receives a first emission signal, an input electrode which receives a high power voltage and an output electrode connected to the second node. The emission signal may be a second emission signal.

In an embodiment, a width of a high duration of the first emission signal in a data writing period when the data voltage is applied to the pixel may be different from a width of a high duration of the first emission signal in a self scan period when the data voltage is not written to the pixel and the light emitting element is turned on.

In an embodiment, the first electrode of the boosting capacitor may be disposed at a first layer connected to the control electrode of the light emitting element initialization switching element. The second electrode of the boosting capacitor may be connected to the output electrode of the data write switching element and disposed at a second layer different from the first layer.

In an embodiment of a pixel according to the present invention, the pixel includes a light emitting element, a driving switching element, a light emitting element initialization switching element and a boosting capacitor. The driving switching element is configured to apply a driving current to the light emitting element. The light emitting element initialization switching element is configured to apply an initialization voltage to a first electrode of the light emitting element. The boosting capacitor includes a first electrode connected to a control electrode of the light emitting element initialization switching element and a second electrode connected to a control electrode of the driving switching element.

In an embodiment, the pixel may further include: a first transistor comprising a control electrode connected to a first node, an input electrode connected to a second node and an output electrode connected to a third node; a second transistor comprising a control electrode which receives a data write gate signal, an input electrode which receives the data voltage and an output electrode connected to a fourth node; a third transistor comprising a control electrode which receives a compensation gate signal, an input electrode connected to the first node and an output electrode connected to the third node; a fourth transistor comprising a control electrode which receives a data initialization gate signal, an input electrode which receives the initialization voltage and an output electrode connected to the first node; a fifth transistor comprising a control electrode which receives the compensation gate signal, an input electrode which receives a reference voltage and an output electrode connected to the fourth node; a sixth transistor comprising a control electrode which receives an emission signal, an input electrode connected to the third node and an output electrode connected to an anode electrode of the light emitting element; and a seventh transistor comprising a control electrode which receives a light emitting element initialization gate signal, an input electrode which receives the initialization voltage and an output electrode connected to the anode electrode of the light emitting element. The driving switching element may be the first transistor. The light emitting element initialization switching element may be the seventh transistor.

In an embodiment, the pixel may further include: a storage capacitor including a first electrode connected to the first node and a second electrode connected to the fourth node; and a hold capacitor including a first electrode which receives a high power voltage and a second electrode connected to the fourth node.

In an embodiment, when a voltage change amount of the control electrode of the first transistor is ΔVGT1 where a voltage of the control electrode is changed by the boosting capacitor in a bias period, a capacitance of the storage capacitor is CST, a capacitance of the hold capacitor is CHOLD, a capacitance of the boosting capacitor is CBOOST, a capacitance of the first transistor T1 is CGT1, a high level of the light emitting element initialization gate signal is VGH and a low level of the light emitting element initialization gate signal is VGL, the voltage change amount may be determined by following Equation $$\Delta VGT1 = \frac{CBOOST}{(CST\ //\ CHOLD) + CGT1 + CBOOST} \times (VGH - VGL),$$

// means a parallel connection of capacitances.

In an embodiment, the pixel may further include an eighth transistor including a control electrode which receives a first emission signal, an input electrode which receives a high power voltage and an output electrode connected to the second node. The emission signal may be a second emission signal.

In an embodiment, the first electrode of the boosting capacitor may be disposed at a first layer connected to the control electrode of the light emitting element initialization switching element. The second electrode of the boosting capacitor may be connected to the control electrode of the driving switching element and disposed at a second layer different from the first layer.

In an embodiment of a display apparatus according to the present invention, the display apparatus includes a display panel, a gate driver, a data driver and an emission driver. The display panel includes a pixel. The gate driver is configured to provide a gate signal to the pixel. The data driver is configured to provide a data voltage to the pixel. The emission driver is configured to provide an emission signal to the pixel. The pixel includes a light emitting element; a data write switching element which receives the data voltage; a driving switching element which applies a driving current to the light emitting element based on the data voltage; a light emitting element initialization switching element which applies an initialization voltage to a first electrode of the light emitting element; and a boosting capacitor including a first electrode connected to a control electrode of the light emitting element initialization switching element and a second electrode connected to an output electrode of the data write switching element.

In an embodiment, the gate driver may include: a normal gate driver which generates a gate signal not applied to the light emitting element initialization switching element; and a bias gate driver which generates a gate signal applied to the light emitting element initialization switching element.

In an embodiment, a stage of the normal gate driver may be configured to receive a first clock signal, a gate high voltage and a gate low voltage. A stage of the bias gate driver may be configured to receive a second clock signal different from the first clock signal, the gate high voltage and the gate low voltage.

In an embodiment, a high level of the first clock signal may be equal to the gate high voltage. A high level of the second clock signal may be greater than the gate high voltage.

In an embodiment, a stage of the normal gate driver may be configured to receive a clock signal, a first gate high voltage and a first gate low voltage. A stage of the bias gate driver may be configured to receive the clock signal, a second gate high voltage different from the first gate high voltage and a second gate low voltage different from the first gate low voltage.

According to the pixel and the display apparatus, in the display apparatus supporting the variable frequency, the additional gate driver and the additional switching element are not formed to operate the bias operation of the driving switching element but the bias operation of the driving switching element may be operated using the boosting capacitor.

Thus, the pixels may be integrated in a high resolution in the display apparatus supporting the variable frequency.

DETAILED DESCRIPTION

Hereinafter, the present invention will be explained in detail with reference to the accompanying drawings.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "At least one" is not to be construed as limiting "a" or "an." "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Figure 1:
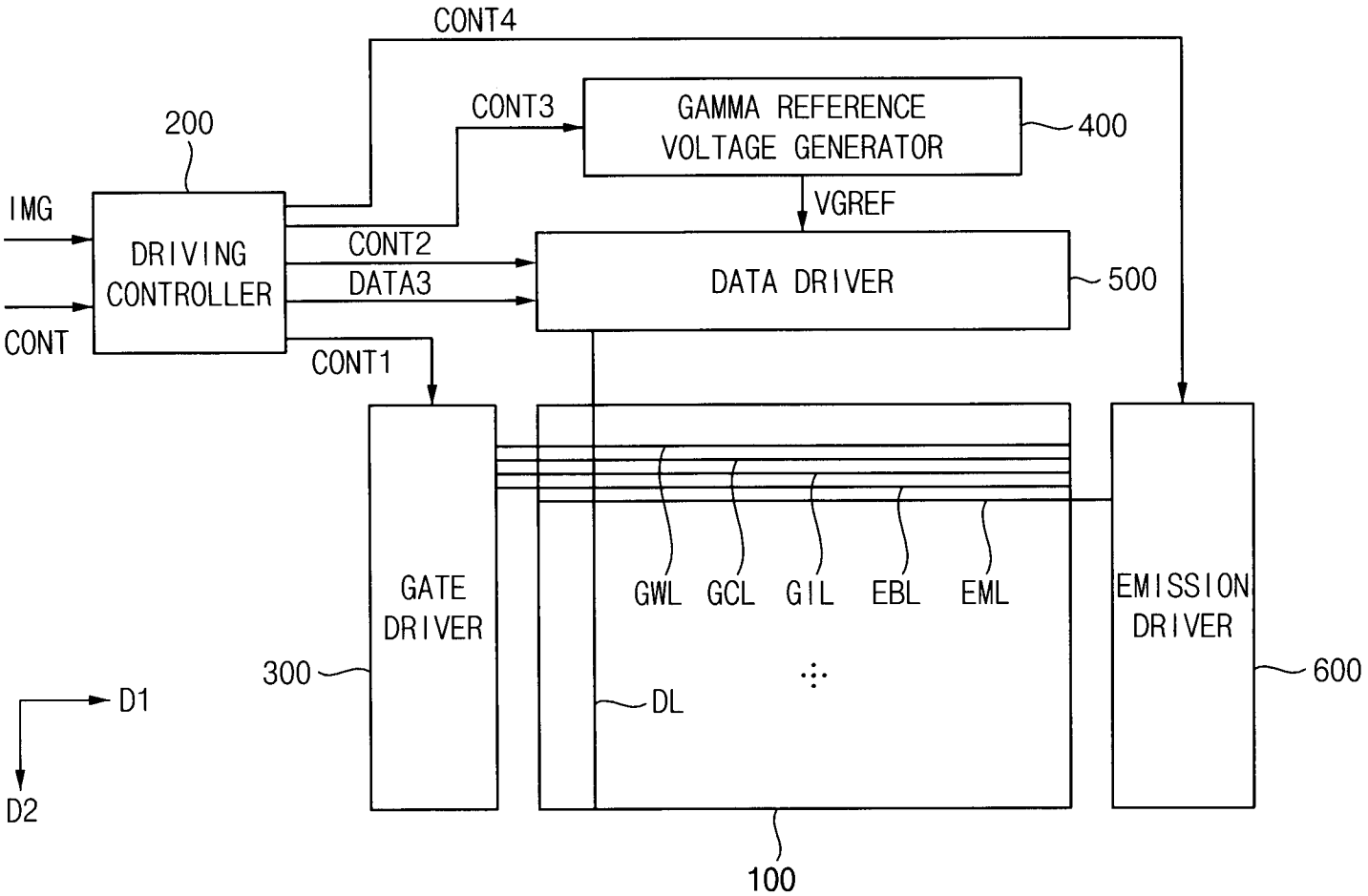
FIG. 1 is a block diagram illustrating a display apparatus according to an embodiment of the present invention.

FIG. 1 is a block diagram illustrating a display apparatus according to an embodiment of the present invention.

Referring to FIG. 1, the display apparatus includes a display panel 100 and a display panel driver. The display panel driver includes a driving controller 200, a gate driver 300, a gamma reference voltage generator 400, a data driver 500 and an emission driver 600.

The display panel 100 has a display region on which an image is displayed and a peripheral region adjacent to the display region.

The display panel 100 includes a plurality of gate lines GWL, GCL, GIL and EBL, a plurality of data lines DL, a plurality of emission lines EML and a plurality of pixels electrically connected to the gate lines GWL, GCL, GIL and EBL, the data lines DL and the emission lines EML. The gate lines GWL, GCL, GIL and EBL may extend in a first direction D1, the data lines DL may extend in a second direction D2 crossing the first direction D1 and the emission lines EML may extend in the first direction D1.

The driving controller 200 receives input image data IMG and an input control signal CONT from an external apparatus. For example, the input image data IMG may include red image data, green image data and blue image data. The input image data IMG may include white image data. The input image data IMG may include magenta image data, cyan image data and yellow image data. The input control signal CONT may include a master clock signal and a data enable signal. The input control signal CONT may further include a vertical synchronizing signal and a horizontal synchronizing signal.

The driving controller 200 generates a first control signal CONT1, a second control signal CONT2, a third control signal CONT3, a fourth control signal CONT4 and a data signal DATA based on the input image data IMG and the input control signal CONT.

The driving controller 200 generates the first control signal CONT1 for controlling an operation of the gate driver 300 based on the input control signal CONT, and outputs the first control signal CONT1 to the gate driver 300. The first control signal CONT1 may include a vertical start signal and a gate clock signal.

The driving controller 200 generates the second control signal CONT2 for controlling an operation of the data driver 500 based on the input control signal CONT, and outputs the second control signal CONT2 to the data driver 500. The second control signal CONT2 may include a horizontal start signal and a load signal.

The driving controller 200 generates the data signal DATA based on the input image data IMG. The driving controller 200 outputs the data signal DATA to the data driver 500.

The driving controller 200 generates the third control signal CONT3 for controlling an operation of the gamma reference voltage generator 400 based on the input control signal CONT, and outputs the third control signal CONT3 to the gamma reference voltage generator 400.

The driving controller 200 generates the fourth control signal CONT4 for controlling an operation of the emission driver 600 based on the input control signal CONT, and outputs the fourth control signal CONT4 to the emission driver 600.

The gate driver 300 generates gate signals transferred through the gate lines GWL, GCL, GIL and EBL in response to the first control signal CONT1 received from the driving controller 200. The gate driver 300 may sequentially output the gate signals to the gate lines GWL, GCL, GIL and EBL.

The gamma reference voltage generator 400 generates a gamma reference voltage VGREF in response to the third control signal CONT3 received from the driving controller 200. The gamma reference voltage generator 400 provides the gamma reference voltage VGREF to the data driver 500. The gamma reference voltage VGREF has a value corresponding to a level of the data signal DATA.

In an embodiment, the gamma reference voltage generator 400 may be disposed in the driving controller 200, or in the data driver 500.

The data driver 500 receives the second control signal CONT2 and the data signal DATA from the driving controller 200, and receives the gamma reference voltages VGREF from the gamma reference voltage generator 400. The data driver 500 converts the data signal DATA into data voltages having an analog type using the gamma reference voltages VGREF. The data driver 500 outputs the data voltages to the data lines DL.

The emission driver 600 generates emission signals to drive the emission lines EML in response to the fourth control signal CONT4 received from the driving controller 200. The emission driver 600 may output the emission signals to the emission lines EML.

Although the gate driver 300 is disposed at a first side of the display panel 100 and the emission driver 600 is disposed at a second side of the display panel 100 opposite to the first side in FIG. 1 for convenience of explanation, the present invention may not be limited thereto. In another embodiment, for example, both of the gate driver 300 and the emission driver 600 may be disposed at the first side of the display panel 100. For example, the gate driver 300 and the emission driver 600 may be integrally formed.

Figure 2:
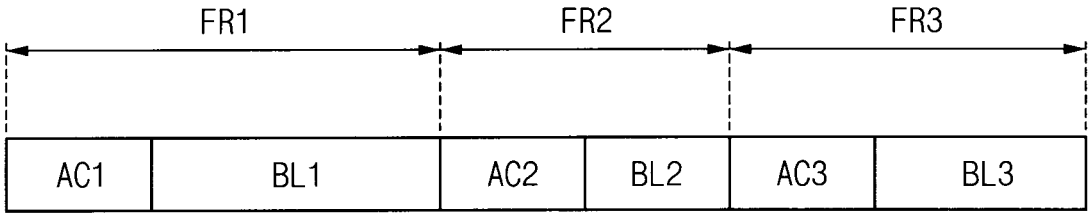
FIG. 2 is a conceptual diagram illustrating a driving frequency of a display panel of FIG. 1.

FIG. 2 is a conceptual diagram illustrating a driving frequency of the display panel 100 of FIG. 1.

Referring to FIGS. 1 and 2, the display panel 100 may be driven in a variable frequency. A first frame FR1 having a first frequency may include a first active period AC1 and a first blank period BL1. A second frame FR2 having a second frequency different from the first frequency may include a second active period AC2 and a second blank period BL2. A third frame FR3 having a third frequency different from the first frequency and the second frequency may include a third active period AC3 and a third blank period BL3.

The first active period AC1 may have a length substantially the same as a length of the second active period AC2. The first blank period BL1 may have a length different from a length of the second blank period BL2.

The second active period AC2 may have the length substantially the same as a length of the third active period AC3. The second blank period BL2 may have the length different from a length of the third blank period BL3.

The display apparatus supporting the variable frequency may include a data writing period in which the data voltage is written to the pixel and a self scan period in which only light emission is operated without writing the data voltage to the pixel. The data writing period may be disposed in the active period AC1, AC2 and AC3. The self scan period may be disposed in the blank period BL1, BL2 and BL3.

Figure 3:
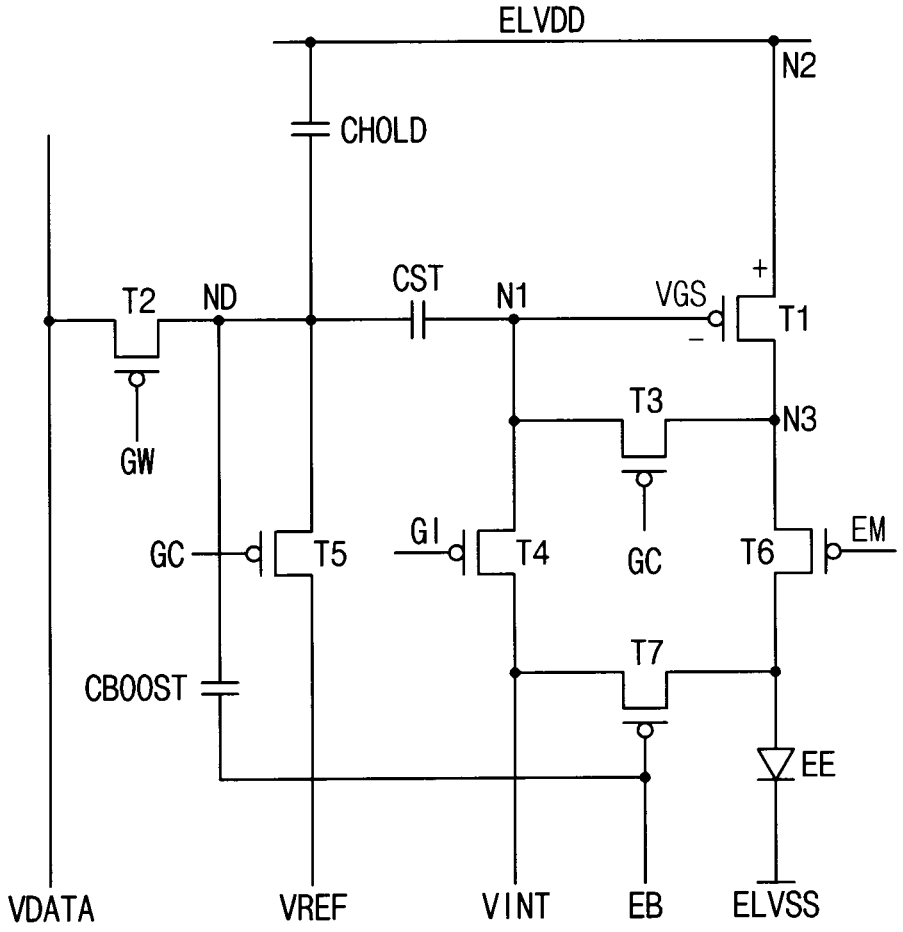
FIG. 3 is a circuit diagram illustrating an example of a pixel of the display panel of FIG. 1.

FIG. 3 is a circuit diagram illustrating an example of a pixel of the display panel 100 of FIG. 1.

Referring to FIGS. 1 to 3, the pixel may include a light emitting element EE, a data write switching element (e.g., T2) receiving a data voltage VDATA from the outside (in other words, writing a data voltage VDATA), a driving switching element (e.g., T1) applying a driving current to the light emitting element EE, and a light emitting element initialization switching element (e.g., T7) applying an initialization voltage VINT to a first electrode (i.e., anode) of the light emitting element EE. The pixel may also include a boosting capacitor CBOOST including a first electrode connected to a control electrode of the light emitting element initialization switching element (e.g., T7) and a second electrode connected to an output electrode of the data write switching element (e.g., T2).

In the present embodiment, the pixel may include: a first transistor T1 including a control electrode connected to a first node N1, an input electrode connected to a second node N2 and an output electrode connected to a third node N3; a second transistor T2 including a control electrode receiving a data write gate signal GW, an input electrode receiving the data voltage VDATA and an output electrode connected to a fourth node ND; and a third transistor T3 including a control electrode receiving a compensation gate signal GC, an input electrode connected to the first node N1 and an output electrode connected to the third node N3. The pixel may also include: a fourth transistor T4 including a control electrode receiving a data initialization gate signal GI, an input electrode receiving the initialization voltage VINT and an output electrode connected to the first node N1; and a fifth transistor T5 including a control electrode receiving the compensation gate signal GC, an input electrode receiving a reference voltage VREF and an output electrode connected to the fourth node ND. The pixel may also include: a sixth transistor T6 including a control electrode receiving an emission signal EM, an input electrode connected to the third node N3 and an output electrode connected to an anode electrode of the light emitting element EE; and a seventh transistor T7 including a control electrode receiving a light emitting element initialization gate signal EB, an input electrode receiving the initialization voltage VINT and an output electrode connected to the anode electrode of the light emitting element EE.

The driving switching element may be the first transistor T1. The data write switching element may be the second transistor T2. The light emitting element initialization switching element may be the seventh transistor T7.

The pixel may further include: a storage capacitor CST including a first electrode connected to the first node N1 and a second electrode connected to the fourth node ND; and a hold capacitor CHOLD including a first electrode receiving a high power voltage ELVDD and a second electrode connected to the fourth node ND.

In the present embodiment, the high power voltage ELVDD may be applied to the second node N2. A low power voltage ELVSS may be applied to a cathode electrode of the light emitting element EE.

Figure 4:
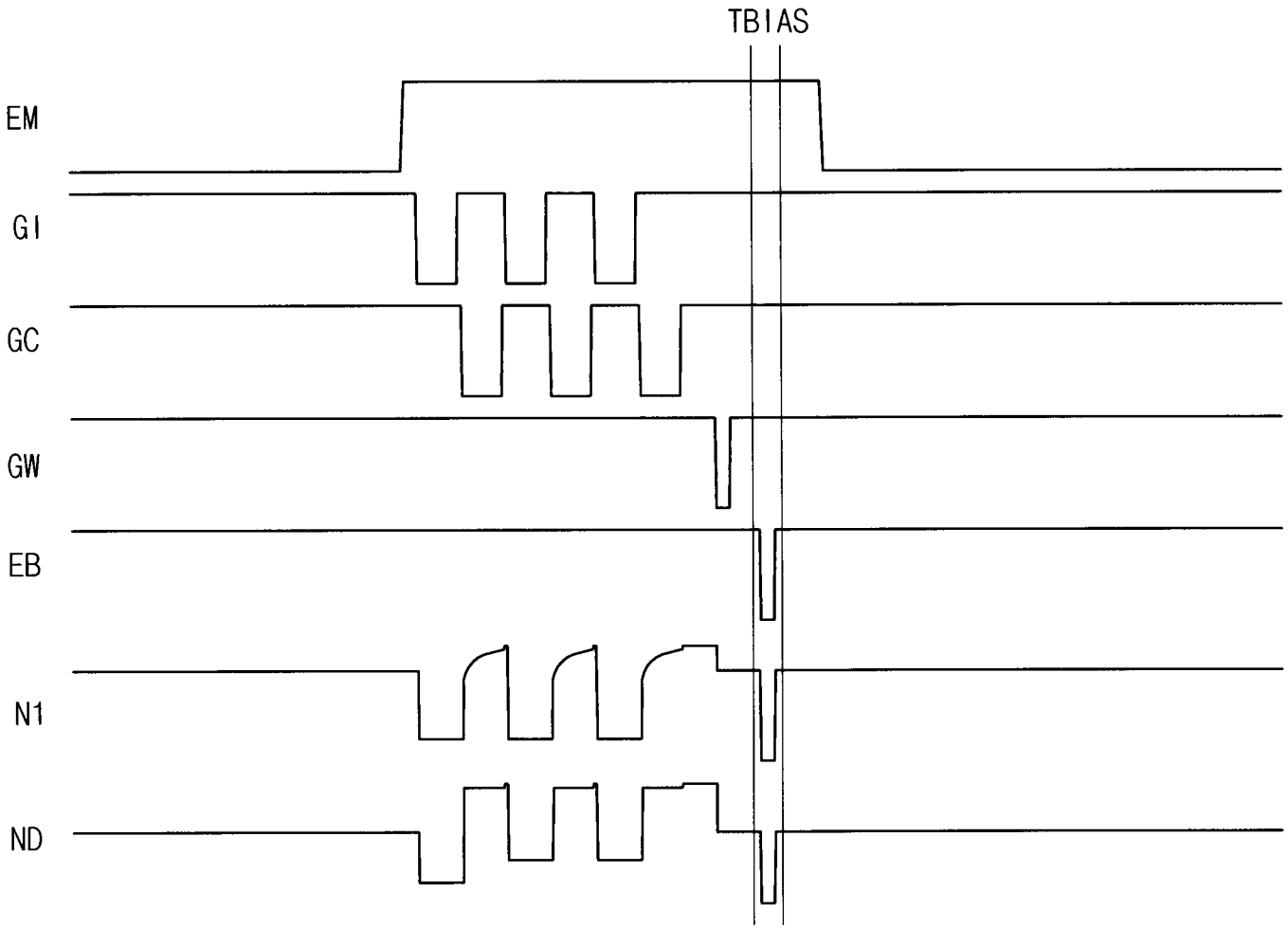
FIG. 4 is a timing diagram illustrating an input signal applied to the pixel of FIG. 3 and a node signal in a data writing period.
Figure 5:
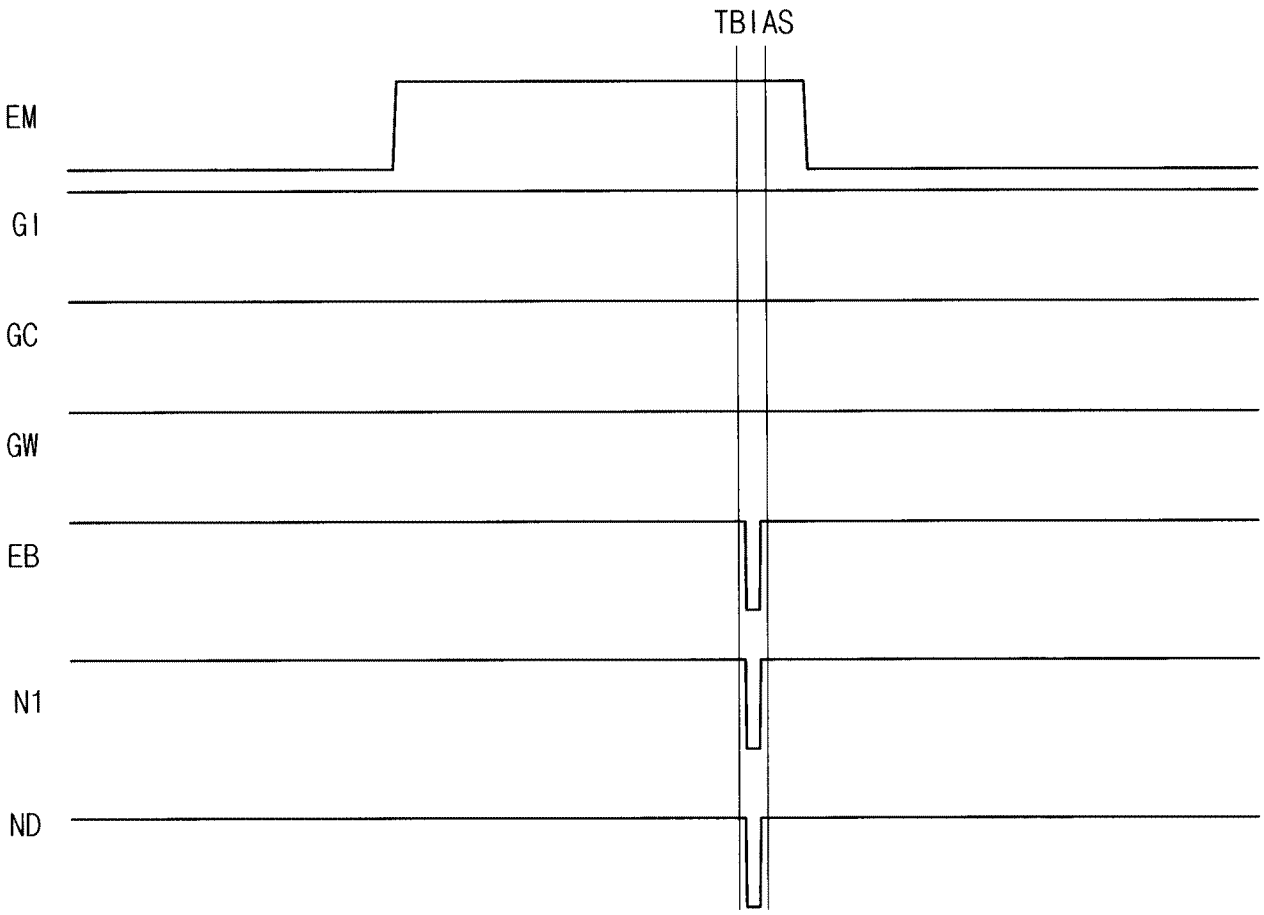
FIG. 5 is a timing diagram illustrating an input signal applied to the pixel of FIG. 3 and a node signal in a self scan period.
Figures 6, 7:
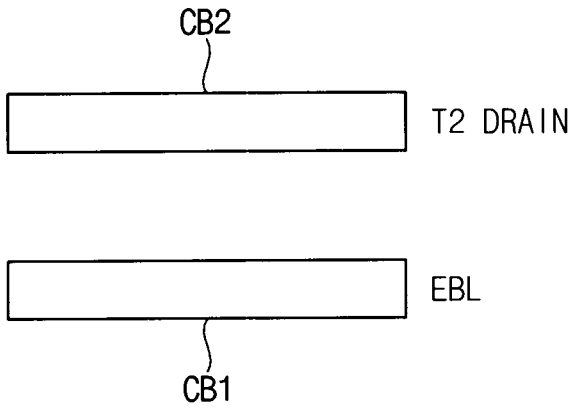
FIG. 6 is a table illustrating a method of determining a capacitance of a boosting capacitor of the pixel of FIG. 3.
FIG. 7 is a conceptual diagram illustrating a layer structure of the boosting capacitor of the pixel of FIG. 3.

FIG. 4 is a timing diagram illustrating an input signal applied to the pixel of FIG. 3 and a node signal in a data writing period. FIG. 5 is a timing diagram illustrating an input signal applied to the pixel of FIG. 3 and a node signal in a self scan period. FIG. 6 is a table illustrating a method of determining a capacitance of a boosting capacitor of the pixel of FIG. 3.

Referring to FIGS. 1 to 6, as shown in FIG. 4, in the data writing period, the data initialization gate signal GI, the compensation gate signal GC and the data write gate signal GW may have active pulses.

In contrast, as shown in FIG. 5, in the self scan period, the data initialization gate signal GI, the compensation gate signal GC and the data write gate signal GW may not have active pulses.

As shown in FIGS. 4 and 5, both of the data writing period and the self scan period may include a bias period TBIAS. In the bias period TBIAS, the data write gate signal GW may have an inactive level, the compensation gate signal GC may have an inactive level, the data initialization gate signal GI may have an inactive level and the light emitting element initialization gate signal EB may have an active level.

In the present embodiment, the driving switching element T1 may operate a bias operation in response to the light emitting element initialization gate signal EB.

When a level of the light emitting element initialization gate signal EB decreases to a low level which is the active level, a voltage of a first electrode of the boosting capacitor CBOOST where the light emitting element initialization gate signal EB is received is decreased. According to the decrease of the voltage of the first electrode of the boosting capacitor CBOOST, a voltage of a second electrode of the boosting capacitor CBOOST is also decreased.

Since the second electrode of the boosting capacitor CBOOST is connected to the fourth node ND, a voltage of the fourth node ND is also decreased.

When the voltage of the fourth node ND is decreased, a voltage of the first node N1 is also decreased by the storage capacitor CST connected between the fourth node N4 and the first node N1.

A voltage of the input electrode of the driving switching element T1 maintains the high power voltage ELVDD but the voltage of the control electrode N1 of the driving switching element T1 is decreased. Therefore, a gate-source voltage VGS of the driving switching element T1 is applied between the input electrode and the control electrode of the driving switching element T1. According to the gate-source voltage VGS of the driving switching element T1, the bias operation of the driving switching element T1 is performed.

When a bias of the driving switching element T1 is T1_VGS_BIAS, a normal voltage level of the control electrode of the driving switching element T1 is VGT1 and a normal bias voltage applied to the input electrode of the driving switching element T1 is VBIAS, the bias T1_VGS_BIAS satisfies the following Equation 1 in a method of applying the bias voltage VBIAS to the input electrode of the driving switching element T1.

$$T1_VGS_BIAS = VBIAS - VGT1 \quad \text{[Equation 1]}$$

In contrast, in the present embodiment, the bias operation of the driving switching element T1 may be performed by not applying the bias voltage VBIAS. For example, in the present embodiment, the bias voltage VBIAS may not be applied but the voltage of the control electrode of the driving switching element T1 may be dropped to operate the bias operation of the driving switching element T1. Therefore, the bias T1_VGS_BIAS according to the present embodiment satisfies the following Equation 2.

$$T1_VGS_BIAS = ELVDD - (VGT1 + \Delta VGT1) \quad \text{[Equation 2]}$$

Herein, in order to operate the same level of bias as in Equation 1, the voltage change amount ΔVGT1 of the control electrode of the driving switching element T1, which amounts to the decrease by the boosting capacitor CBOOST, may satisfy ELVDD—VBIAS. The change amount ΔVGT1 may be determined to be approximately 1.5 voltages (V) to 2.0V depending on the display apparatus.

In the present embodiment, when a voltage change amount of the control electrode of the first transistor T1 is ΔVGT1 where a voltage of the control electrode is changed by the boosting capacitor CBOOST in a bias period, a capacitance of the storage capacitor CST is Cst, a capacitance of the hold capacitor CHOLD is Chold, a capacitance of the boosting capacitor CBOOST is Cboost, a capacitance of the first transistor T1 is CGT1, a high level of the light emitting element initialization gate signal is VGH and a low level of the light emitting element initialization gate signal is VGL, the voltage change amount ΔVGT1 may be determined by following Equation 3.

[Equation 3]

$$\Delta VGT1 = \frac{CBOOST}{CST + (CHOLD \,//\, CGT1) + CBOOST} \times (VGH - VGL),$$

herein, // means a parallel connection of capacitances.

As shown in FIG. 6, when Cst and Chold are 90 femtofarads (fF), VGH is 7.5V and VGL is −8V, the capacitance Cboost of the boosting capacitor CBOOST which make the change amount ΔVGT1 (change amount of T1 @BOOSTING, as used herein "@BOOSTING" means "when a boosting occurs") close to 1.5V to 2.0V (a target change amount ΔVGT1) may be 20 fF or 30 fF. In this way, the capacitance Cboost of the boosting capacitor CBOOST may be determined according to the target change amount ΔVGT1.

FIG. 7 is a conceptual diagram illustrating a layer structure of the boosting capacitor of the pixel of FIG. 3.

Referring to FIGS. 1 to 7, a first electrode CB1 of the boosting capacitor CBOOST may be disposed at a first layer connected to the control electrode of the light emitting element initialization switching element T7. The first electrode CB1 may be connected to a gate line EBL applying the light emitting element initialization gate signal EB. A second electrode CB2 of the boosting capacitor CBOOST may be connected to the output electrode T2_DRAIN of the data write switching element T2. The second electrode CB2 may be disposed at a second layer different from the first layer.

Figure 8:
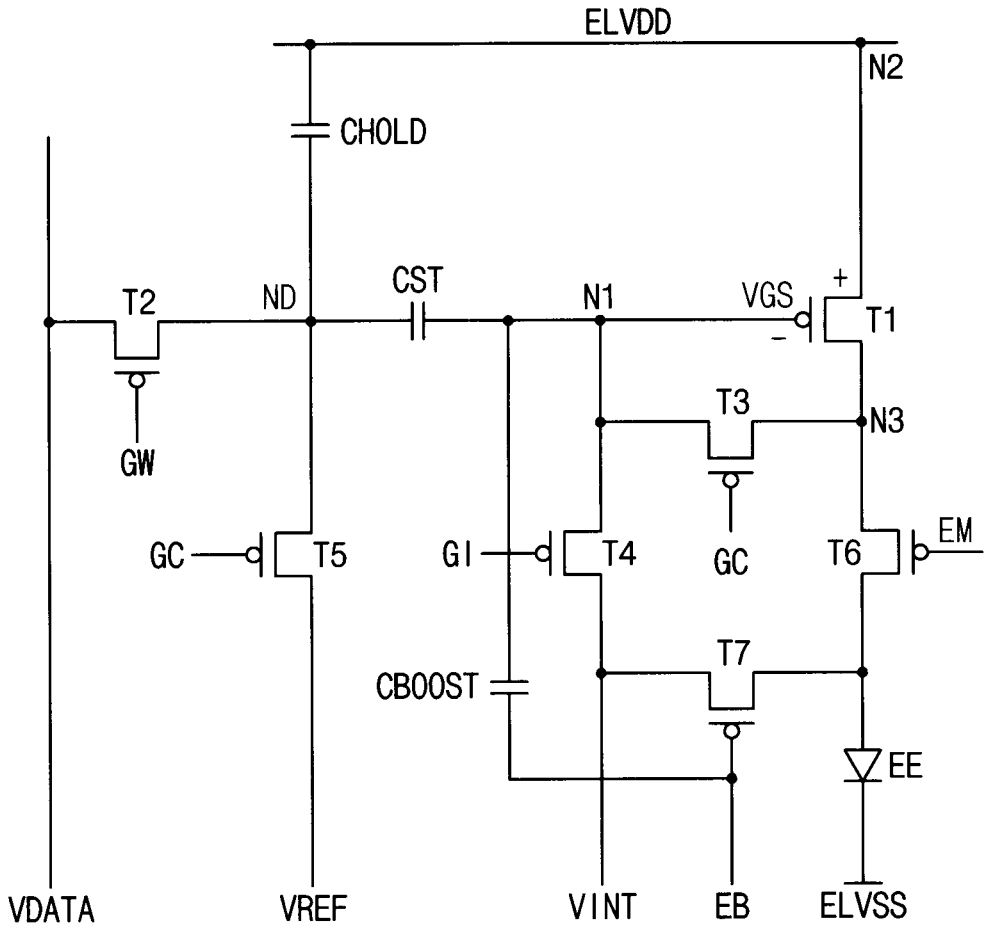
FIG. 8 is a circuit diagram illustrating another example of a pixel of the display panel of FIG. 1.
Figures 9, 10:
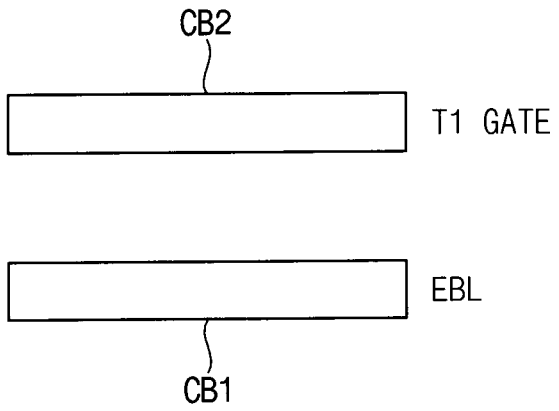
FIG. 9 is a table illustrating a method of determining a capacitance of a boosting capacitor of the pixel of FIG. 8.
FIG. 10 is a conceptual diagram illustrating a layer structure of the boosting capacitor of the pixel of FIG. 8.

FIG. 8 is a circuit diagram illustrating another example of a pixel of the display panel 100 of FIG. 1. FIG. 9 is a table illustrating a method of determining a capacitance of a boosting capacitor of the pixel of FIG. 8. FIG. 10 is a conceptual diagram illustrating a layer structure of the boosting capacitor of the pixel of FIG. 8.

Referring to FIGS. 1, 2, 4, 5 and 8 to 10, the pixel may include a light emitting element EE, a driving switching element (e.g., T1) applying a driving current to the light emitting element EE, and a light emitting element initialization switching element (e.g., T7) applying an initialization voltage VINT to a first electrode of the light emitting element EE. The pixel may also include a boosting capacitor CBOOST including a first electrode connected to a control electrode of the light emitting element initialization switching element (e.g., T7) and a second electrode connected to a control electrode of the driving switching element (e.g., T1).

In the present embodiment, the pixel may include: a first transistor T1 including a control electrode connected to a first node N1, an input electrode connected to a second node N2 and an output electrode connected to a third node N3; a second transistor T2 including a control electrode receiving a data write gate signal GW, an input electrode receiving the data voltage VDATA and an output electrode connected to a fourth node ND; and a third transistor T3 including a control electrode receiving a compensation gate signal GC, an input electrode connected to the first node N1 and an output electrode connected to the third node N3. The pixel may also include: a fourth transistor T4 including a control electrode receiving a data initialization gate signal GI, an input electrode receiving the initialization voltage VINT and an output electrode connected to the first node N1; and a fifth transistor T5 including a control electrode receiving the compensation gate signal GC, an input electrode receiving a reference voltage VREF and an output electrode connected to the fourth node ND/The pixel may also include: a sixth transistor T6 including a control electrode receiving an emission signal EM, an input electrode connected to the third node N3 and an output electrode connected to an anode electrode of the light emitting element EE; and a seventh transistor T7 including a control electrode receiving a light emitting element initialization gate signal EB, an input electrode receiving the initialization voltage VINT and an output electrode connected to the anode electrode of the light emitting element EE.

The driving switching element may be the first transistor T1. The light emitting element initialization switching element may be the seventh transistor T7.

The pixel may further include a storage capacitor CST including a first electrode connected to the first node N1 and a second electrode connected to the fourth node ND and a hold capacitor CHOLD including a first electrode receiving a high power voltage ELVDD and a second electrode connected to the fourth node ND.

In the present embodiment, the high power voltage ELVDD may be applied to the second node N2. A low power voltage ELVSS may be applied to a cathode electrode of the light emitting element EE.

As shown in FIGS. 4 and 5, both of the data writing period and the self scan period may include a bias period TBIAS. In the bias period TBIAS, the data write gate signal GW may have an inactive level, the compensation gate signal GC may have an inactive level, the data initialization gate signal GI may have an inactive level and the light emitting element initialization gate signal EB may have an active level.

In the present embodiment, when a voltage change amount of the control electrode of the first transistor T1 is ΔVGT1 where a voltage of the control electrode is changed by the boosting capacitor CBOOST in a bias period, a capacitance of the storage capacitor CST is Cst, a capacitance of the hold capacitor CHOLD is Chold, a capacitance of the boosting capacitor CBOOST is Cboost, a capacitance of the first transistor T1 is CGT1, a high level of the light emitting element initialization gate signal is VGH and a low level of the light emitting element initialization gate signal is VGL, the change amount ΔVGT1 may be determined by following Equation 4.

[Equation 4]

$$\Delta VGT1 = \frac{CBOOST}{(CST\ //\ CHOLD) + CGT1 + CBOOST} \times (VGH - VGL),$$

herein, // means a parallel connection of capacitances.

As shown in FIG. 9, when Cst and Chold are 90 fF, VGH is 7.5V and VGL is −8V, the capacitance Cboost of the boosting capacitor CBOOST which make the change amount ΔVGT1 (change amount of T1 @BOOSTING) close to 1.5V to 2.0V (a target change amount ΔVGT1) may be 10 fF and 15 fF. In this way, the capacitance Cboost of the boosting capacitor CBOOST may be determined according to the target change amount ΔVGT1.

As shown in FIG. 10, a first electrode CB1 of the boosting capacitor CBOOST may be disposed at a first layer connected to the control electrode of the light emitting element initialization switching element T7. The first electrode CB1 may be connected to a gate line EBL applying the light emitting element initialization gate signal. A second electrode CB2 of the boosting capacitor CBOOST may be connected to the control electrode T1_GATE of the driving switching element T1. The second electrode CB2 may be disposed at a second layer different from the first layer.

Figure 11:
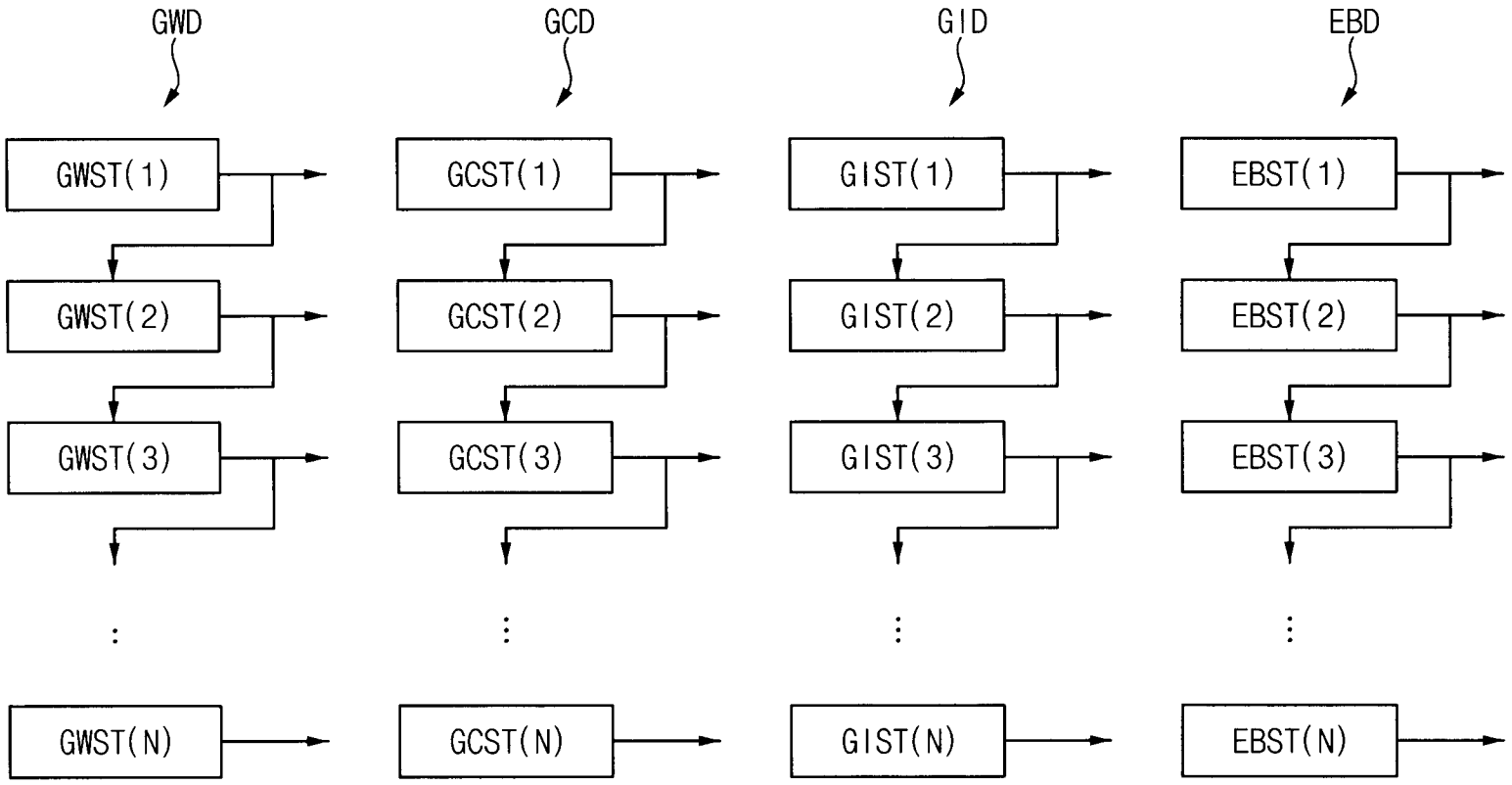
FIG. 11 is a block diagram illustrating a gate driver of FIG. 1.
Figure 12:
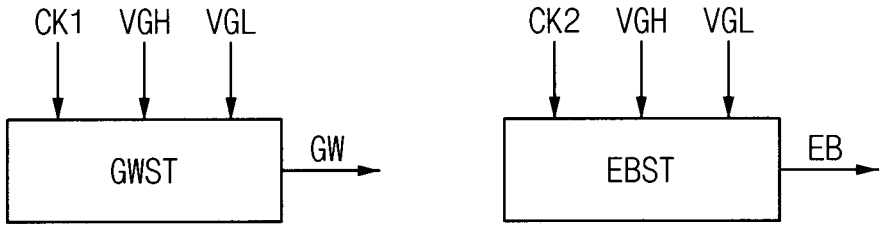
FIG. 12 is a conceptual diagram illustrating an example of a stage of a normal gate driver of the gate driver of FIG. 1 and an example of a stage of a bias gate driver of the gate driver of FIG. 1.
Figure 13:
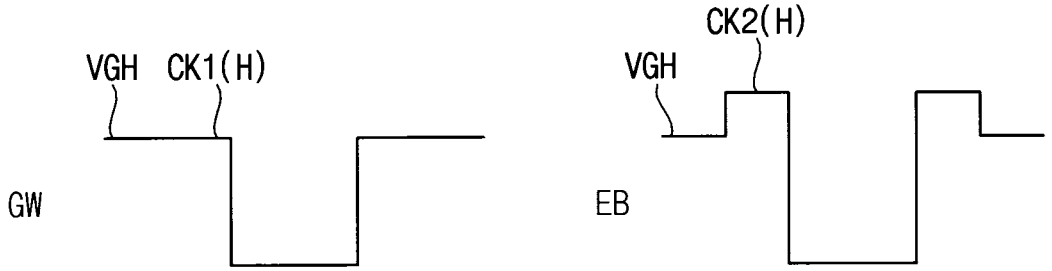
FIG. 13 is a waveform diagram illustrating an output signal of the stage of the normal gate driver of FIG. 12 and an output signal of the stage of the bias gate driver of FIG. 12.
Figure 14:
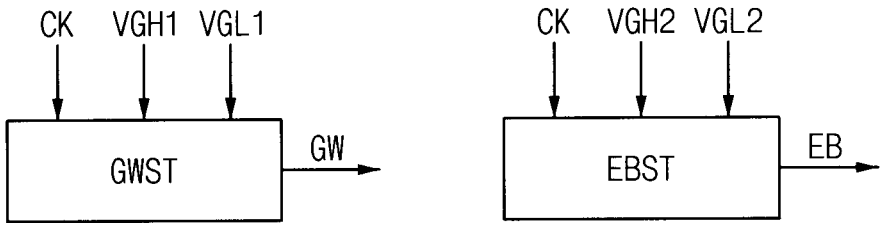
FIG. 14 is a conceptual diagram illustrating another example of a stage of a normal gate driver of the gate driver of FIG. 1 and another example of a stage of a bias gate driver of the gate driver of FIG. 1.

FIG. 11 is a block diagram illustrating the gate driver 300 of FIG. 1. FIG. 12 is a conceptual diagram illustrating an example of a stage GWST of a normal gate driver of the gate driver 300 of FIG. 1 and an example of a stage EBST of a bias gate driver of the gate driver 300 of FIG. 1. FIG. 13 is a waveform diagram illustrating an output signal GW of the stage GWST of the normal gate driver of FIG. 12 and an output signal EB of the stage EBST of the bias gate driver of FIG. 12. FIG. 14 is a conceptual diagram illustrating another example of a stage GWST of a normal gate driver of the gate driver 300 of FIG. 1 and another example of a stage EBST of a bias gate driver of the gate driver 300 of FIG. 1.

Referring to FIGS. 1 to 14, the gate driver 300 may include a normal gate driver generating a gate signal not applied to the light emitting element initialization switching element T7 and a bias gate driver generating a gate signal applied to the light emitting element initialization switching element T7.

In an embodiment, for example, the normal gate driver may include a data write gate driver GWD, a compensation gate driver GCD and a data initialization gate driver GID. The bias gate driver may include a light emitting element initialization gate driver EBD.

In an embodiment, for example, the data write gate driver GWD may include a first to N-th stages GWST(1) to GWST(N). The compensation gate driver GCD may include a first to N-th stages GCST(1) to GCST(N). The data initialization gate driver GID may include a first to N-th stages GIST(1) to GIST(N). The light emitting element initialization gate driver EBD may include a first to N-th stages EBST(1) to EBST(N).

Referring to FIGS. 12 and 13, the stage GWST of the normal gate driver may receive a first clock signal CK1, a gate high voltage VGH and a gate low voltage VGL. In contrast, the stage EBST of the bias gate driver which is related to the bias operation may receive a second clock signal CK2 different from the first clock signal CK1, the gate high voltage VGH and the gate low voltage VGL.

As shown in FIG. 13, a high level CK1(H) of the first clock signal CK1 is equal to the gate high voltage VGH. A high level CK2(H) of the second clock signal CK2 may be greater than the gate high voltage VGH.

According to FIGS. 12 and 13, the size of the boosting capacitor CBOOST related to the bias operation may be decreased by increasing the high level CK2(H) of the second clock signal CK2.

Referring to FIG. 14, the stage GWST of the normal gate driver may receive a clock signal CK, a first gate high voltage VGH1 and a first gate low voltage VGL1. In contrast, the stage EBST of the bias gate driver may receive the clock signal CK, a second gate high voltage VGH2 different from the first gate high voltage VGH1 and a second gate low voltage VGL2 different from the first gate low voltage VGL1.

According to FIG. 14, the size of the boosting capacitor CBOOST related to the bias operation may be decreased by adjusting the levels of the second gate high voltage VGH2 and the second gate low voltage VGL2.

Figure 15:
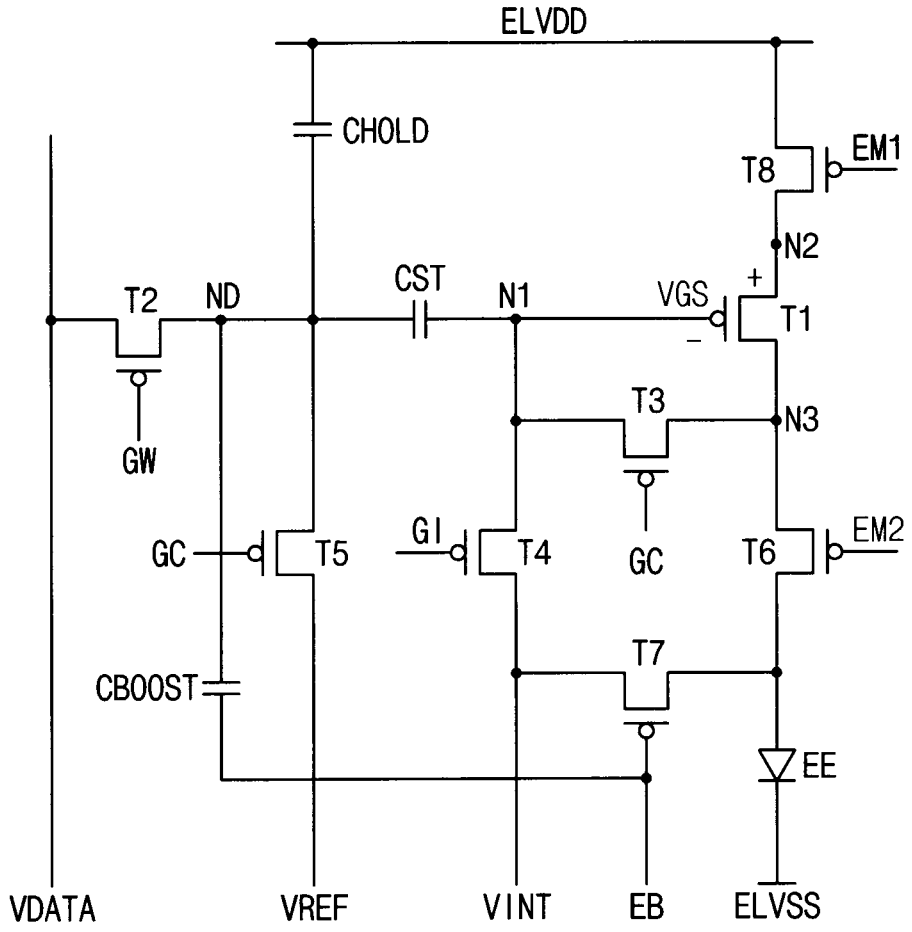
FIG. 15 is a circuit diagram illustrating still another example of a pixel of the display panel of FIG. 1.
Figure 16:
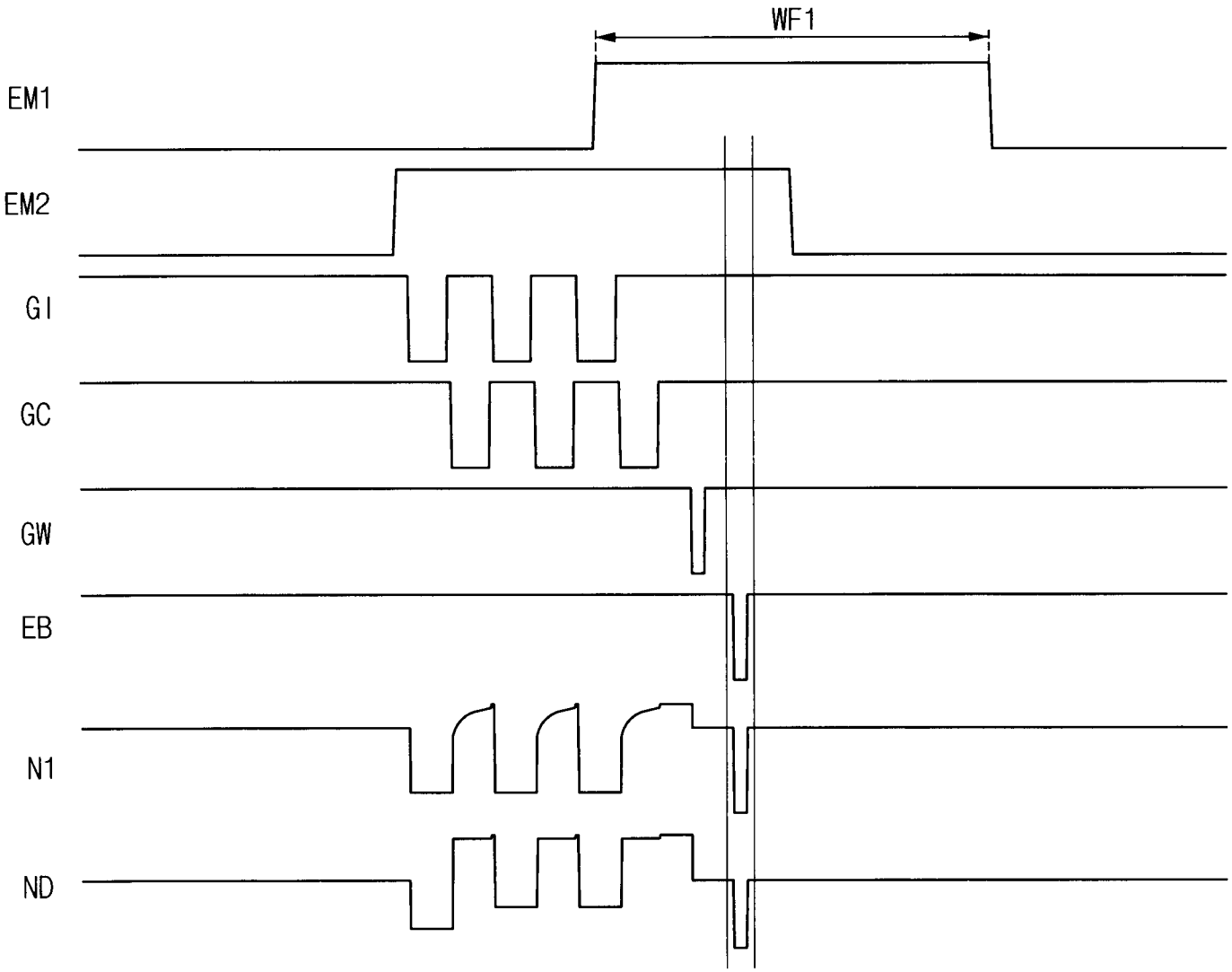
FIG. 16 is a timing diagram illustrating an input signal applied to the pixel of FIG. 15 and a node signal in a data writing period.
Figure 17:
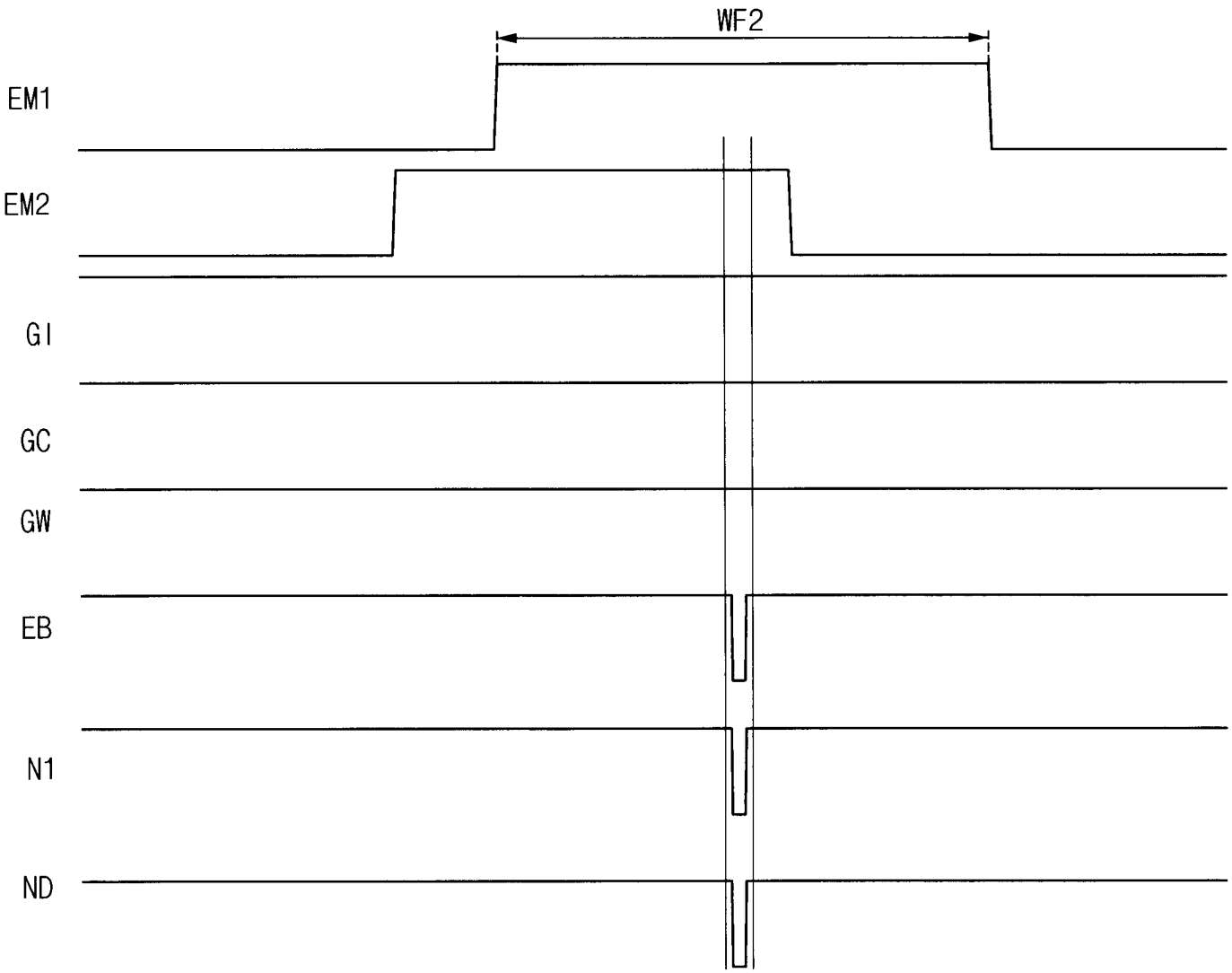
FIG. 17 is a timing diagram illustrating an input signal applied to the pixel of FIG. 15 and a node signal in a self scan period.

FIG. 15 is a circuit diagram illustrating still another example of a pixel of the display panel 100 of FIG. 1. FIG. 16 is a timing diagram illustrating an input signal applied to the pixel of FIG. 15 and a node signal in a data writing period. FIG. 17 is a timing diagram illustrating an input signal applied to the pixel of FIG. 15 and a node signal in a self scan period.

Referring to FIGS. 15 to 17, the pixel may include: a light emitting element EE, a data write switching element (e.g., T2) receiving a data voltage VDATA, a driving switching element (e.g., T1) applying a driving current to the light emitting element EE, and a light emitting element initialization switching element (e.g., T7) applying an initialization voltage VINT to a first electrode of the light emitting element EE. and the pixel may also include a boosting capacitor CBOOST including a first electrode connected to a control electrode of the light emitting element initialization switching element (e.g., T7) and a second electrode connected to an output electrode of the data write switching element (e.g., T2).

In the present embodiment, the pixel may include: a first transistor T1 including a control electrode connected to a first node N1, an input electrode connected to a second node N2 and an output electrode connected to a third node N3; a second transistor T2 including a control electrode receiving a data write gate signal GW, an input electrode receiving the data voltage VDATA and an output electrode connected to a fourth node ND; and a third transistor T3 including a control electrode receiving a compensation gate signal GC, an input electrode connected to the first node N1 and an output electrode connected to the third node N3. The pixel may also include: a fourth transistor T4 including a control electrode receiving a data initialization gate signal GI, an input electrode receiving the initialization voltage VINT and an output electrode connected to the first node N1 and a fifth transistor T5 including a control electrode receiving the compensation gate signal GC, an input electrode receiving a reference voltage VREF and an output electrode connected to the fourth node ND. The pixel may also include: a sixth transistor T6 including a control electrode receiving a second emission signal EM2, an input electrode connected to the third node N3 and an output electrode connected to an anode electrode of the light emitting element EE; and a seventh transistor T7 including a control electrode receiving a light emitting element initialization gate signal EB, an input electrode receiving the initialization voltage VINT and an output electrode connected to the anode electrode of the light emitting element EE.

The driving switching element may be the first transistor T1. The data write switching element may be the second transistor T2. The light emitting element initialization switching element may be the seventh transistor T7.

In the present embodiment, the pixel may further include an eighth transistor T8 including a control electrode receiving a first emission signal EM1, an input electrode receiving a high power voltage ELVDD and an output electrode connected to the second node N2. In the present embodiment, the first emission signal EM1 and the second emission signal EM2 are separated so that a bias operation may be operated by applying the high power voltage ELVDD to the input electrode of the first transistor T1 using the first emission signal EM1.

The pixel may further include a storage capacitor CST including a first electrode connected to the first node N1 and a second electrode connected to the fourth node ND; and a hold capacitor CHOLD including a first electrode receiving the high power voltage ELVDD and a second electrode connected to the fourth node ND.

In the present embodiment, a low power voltage ELVSS may be applied to a cathode electrode of the light emitting element EE.

As shown in FIGS. 16 and 17, a width WF1 of a high duration of the first emission signal EM1 in a data writing period when the data voltage is written (e.g., applied) to the pixel may be different from a width WF2 of a high duration of the first emission signal EM1 in a self scan period when the data voltage is not written to the pixel and the light emitting element is turned on. As used herein, "high duration" means a duration during with a signal level is high. For example, the width WF1 of the high duration of the first emission signal EM1 in a data writing period when the data voltage is written to the pixel may be less than the width WF2 of the high duration of the first emission signal EM1 in a self scan period when the data voltage is not written to the pixel and the light emitting element is turned on.

In a low duration of the first emission signal EM1, the eighth transistor T8 is turned on so that the bias operation may be operated using the high power voltage ELVDD. A degree of the bias operation using the high power voltage ELVDD may be properly adjusted by adjusting the widths WF1 and WF2 of the high duration of the first emission signal EM1. As explained above, a difference in degrees of the bias operations in the data writing period and the self scan period may be adjusted by adjusting the bias operation using the high power voltage ELVDD.

Figure 18:
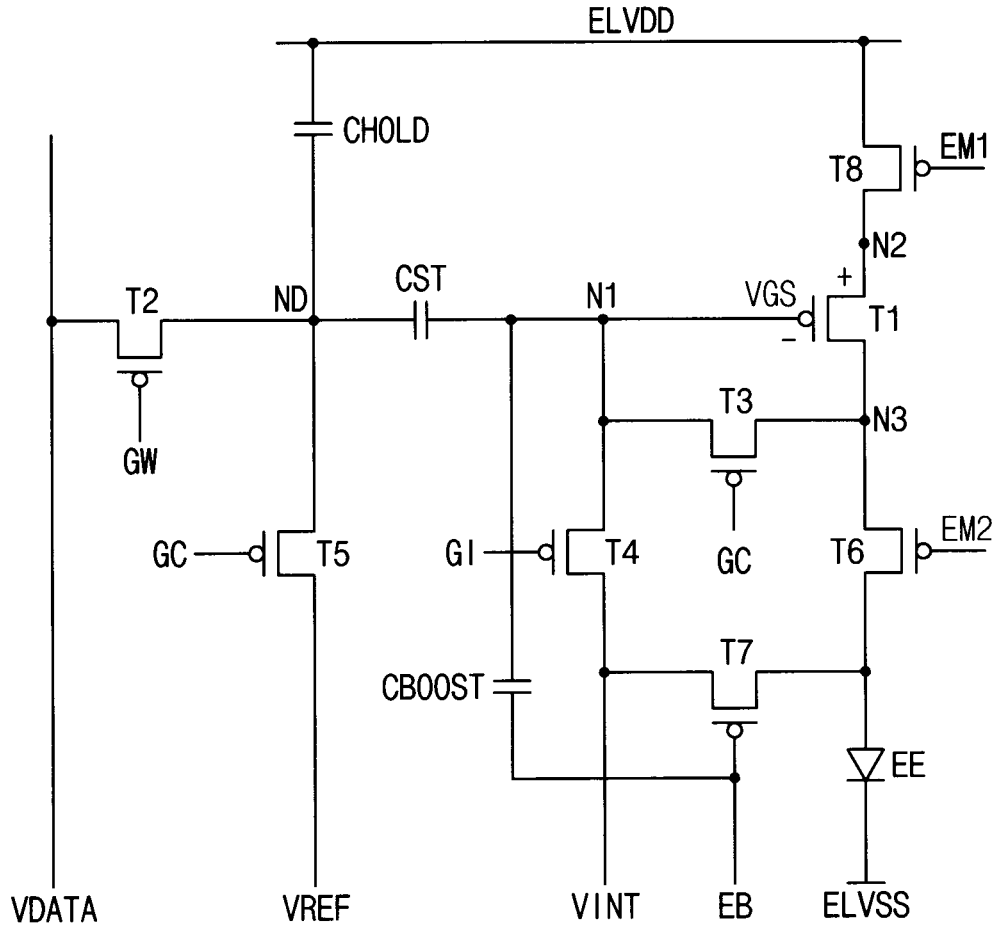
FIG. 18 is a circuit diagram illustrating an example of a pixel of the display panel of FIG. 1.

FIG. 18 is a circuit diagram illustrating yet another example of a pixel of the display panel of FIG. 1.

Referring to FIG. 18, the pixel may include: a light emitting element EE, a driving switching element (e.g., T1) applying a driving current to the light emitting element EE, and a light emitting element initialization switching element (e.g., T7) applying an initialization voltage VINT to a first electrode of the light emitting element EE. and the pixel may also include a boosting capacitor CBOOST including a first electrode connected to a control electrode of the light emitting element initialization switching element (e.g., T7) and a second electrode connected to a control electrode of the driving switching element (e.g., T1).

In the present embodiment, the pixel may include: a first transistor T1 including a control electrode connected to a first node N1, an input electrode connected to a second node N2 and an output electrode connected to a third node N3; a second transistor T2 including a control electrode receiving a data write gate signal GW, an input electrode receiving the data voltage VDATA and an output electrode connected to a fourth node ND; and a third transistor T3 including a control electrode receiving a compensation gate signal GC, an input electrode connected to the first node N1 and an output electrode connected to the third node N3. The pixel may include: a fourth transistor T4 including a control electrode receiving a data initialization gate signal GI, an input electrode receiving the initialization voltage VINT and an output electrode connected to the first node N1, and a fifth transistor T5 including a control electrode receiving the compensation gate signal GC, an input electrode receiving a reference voltage VREF and an output electrode connected to the fourth node ND. The pixel may also include a sixth transistor T6 including a control electrode receiving a second emission signal EM2, an input electrode connected to the third node N3 and an output electrode connected to an anode electrode of the light emitting element EE, and a seventh transistor T7 including a control electrode receiving a light emitting element initialization gate signal EB, an input electrode receiving the initialization voltage VINT and an output electrode connected to the anode electrode of the light emitting element EE.

The driving switching element may be the first transistor T1. The light emitting element initialization switching element may be the seventh transistor T7.

In the present embodiment, the pixel may further include an eighth transistor T8 including a control electrode receiving a first emission signal EM1, an input electrode receiving a high power voltage ELVDD and an output electrode connected to the second node N2. In the present embodiment, the first emission signal EM1 and the second emission signal EM2 are separated so that a bias operation may be operated by applying the high power voltage ELVDD to the input electrode of the first transistor T1 using the first emission signal EM1.

The pixel may further include a storage capacitor CST including a first electrode connected to the first node N1 and a second electrode connected to the fourth node ND and a hold capacitor CHOLD including a first electrode receiving the high power voltage ELVDD and a second electrode connected to the fourth node ND.

In the present embodiment, a low power voltage ELVSS may be applied to a cathode electrode of the light emitting element EE.

Like FIGS. 16 and 17, in the present embodiment, in the low duration of the first emission signal EM1, the eighth transistor T8 is turned on so that the bias operation may be operated using the high power voltage ELVDD. A degree of the bias operation using the high power voltage ELVDD may be properly adjusted by adjusting the widths WF1 and WF2 of the high duration of the first emission signal EM1. As explained above, a difference in degrees of the bias operations in the data writing period and the self scan period may be adjusted by adjusting the bias operation using the high power voltage ELVDD.

Figure 19:
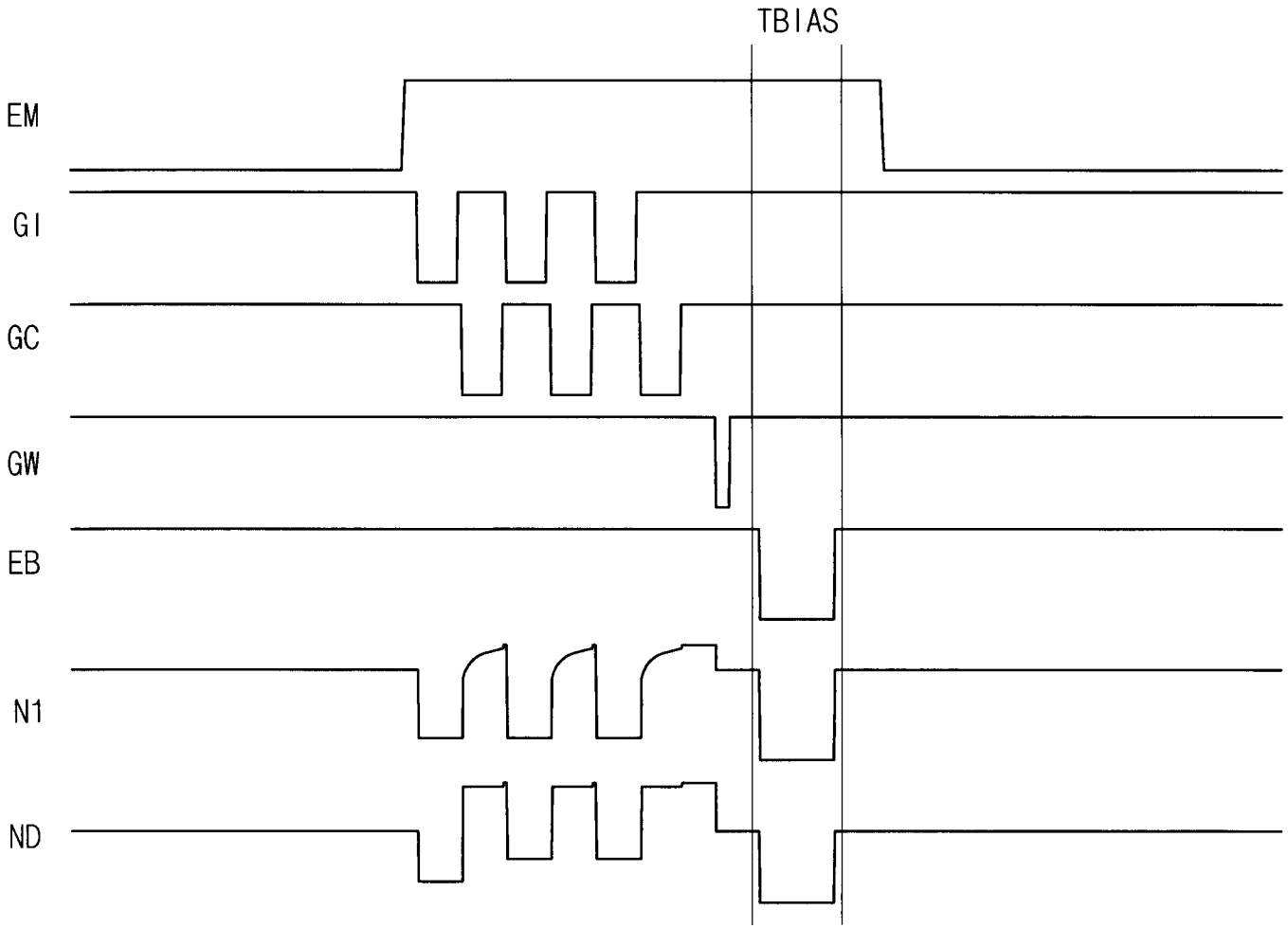
FIG. 19 is a timing diagram illustrating an input signal applied to the pixel of FIG. 3 and a node signal in a data writing period.

FIG. 19 is a timing diagram illustrating an input signal applied to the pixel of FIG. 3 and a node signal in a data writing period.

FIG. 19 illustrates a case in which the width of the bias period TBIAS is increased that the timing diagram of FIG. 4. In the present embodiment, the degree of the bias of the driving switching element T1 may be properly adjusted by adjusting the width of the bias period TBIAS.

In an embodiment, for example, when a sufficient degree of bias is not achieved by the bias period TBIAS of FIG. 4, the length of the bias period TBIAS may be increased as shown in FIG. 19. Alternatively, in order to properly adjust the degree of bias, a short duration of the bias period TBIAS may be set as shown in FIG. 4 and a long duration of the bias period TBIAS may be set as shown in FIG. 19. In addition, by setting the length of the bias period TBIAS different from each other in the data writing period and in the self scan period, a difference of the degree of bias between the data writing period and the self scan period may be compensated.

Figure 20:
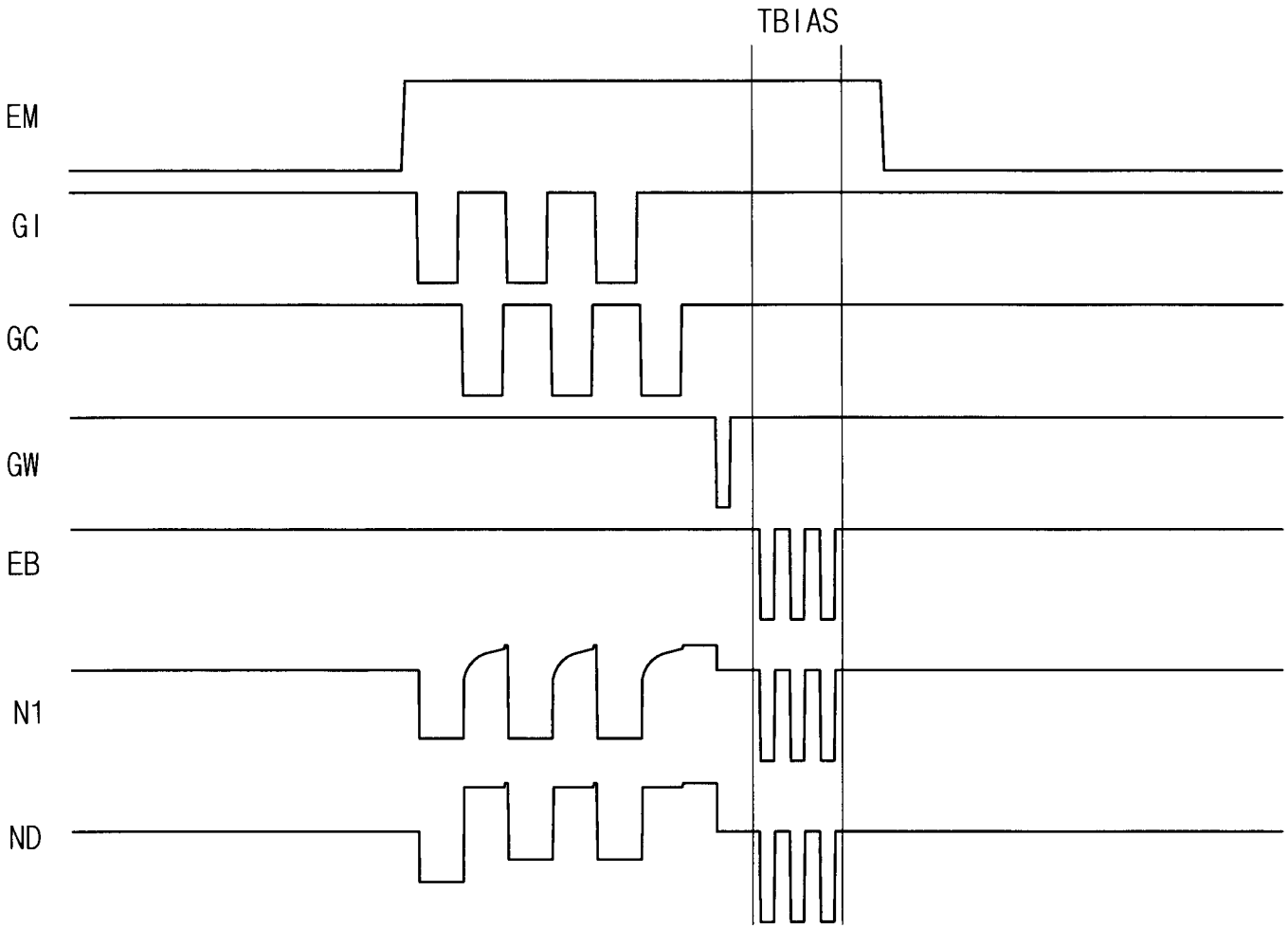
FIG. 20 is a timing diagram illustrating an input signal applied to the pixel of FIG. 3 and a node signal in a data writing period.

FIG. 20 is a timing diagram illustrating an input signal applied to the pixel of FIG. 3 and a node signal in a data writing period.

FIG. 20 illustrates a case in which the width of the bias period TBIAS is increased that the timing diagram of FIG. 4 and the light emitting element initialization gate signal EB has a plurality of active pulses in the bias period TBIAS.

In an embodiment, for example, in the bias period TBIAS, the data write gate signal GW maintains an inactive level, the compensation gate signal GC maintains an inactive level, the data initialization gate signal GI maintains an inactive level and the light emitting element initialization gate signal EB may have a plurality of pulses having an active level.

In the present embodiment, the degree of the bias may be properly adjusted by adjusting the number of the pulses of the light emitting element initialization gate signal EB in the bias period TBIAS.

In an embodiment, for example, when a sufficient degree of bias is not achieved by the number (e.g., one time) of bias operations (the number of the pulses of the light emitting element initialization gate signal EB) of FIG. 4, the number of the bias operations (the number of the pulses of the light emitting element initialization gate signal EB) may be increased as shown in FIG. 20. Alternatively, in order to properly adjust the degree of bias, the number of the bias operations may be set to one time as shown in FIG. 4 and the number of the bias operations may be set to multiple times as shown in FIG. 20. In addition, by setting the number of the bias operations different from each other in the data writing period and in the self scan period, a difference of the degree of bias between the data writing period and the self scan period may be compensated.

According to the present embodiment, in the display apparatus supporting the variable frequency, the additional gate driver and the additional switching element are not formed to operate the bias operation of the driving switching element but the bias operation of the driving switching element may be operated using the boosting capacitor CBOOST.

Thus, the pixels may be integrated in a high resolution in the display apparatus supporting the variable frequency.

According to the pixel and the display apparatus of the present embodiment as explained above, the pixels of the display panel may be integrated in a high resolution.

The foregoing is illustrative of the present invention and is not to be construed as limiting thereof. Although a few example embodiments of the present invention have been described, those skilled in the art will readily appreciate that many modifications are possible in the example embodiments without materially departing from the novel teachings and advantages of the present invention. Accordingly, all such modifications are intended to be included within the scope of the present invention as defined in the claims. In the claims, means-plus-function clauses are intended to cover the structures described herein as performing the recited function and not only structural equivalents but also equivalent structures. Therefore, it is to be understood that the foregoing is illustrative of the present invention and is not to be construed as limited to the specific example embodiments disclosed, and that modifications to the disclosed example embodiments, as well as other example embodiments, are intended to be included within the scope of the appended claims. The present invention is defined by the following claims, with equivalents of the claims to be included therein.

What is claimed is:

1. A pixel comprising:

a light emitting element;

a data write switching element which receives a data voltage from outside;

a driving switching element which applies a driving current to the light emitting element based on the data voltage;

a light emitting element initialization switching element which applies an initialization voltage to a first electrode of the light emitting element; and a boosting capacitor including a first electrode directly connected to a control electrode of the light emitting element initialization switching element and a second electrode directly connected to an output electrode of the data write switching element.

2. The pixel of claim 1, wherein the pixel further comprises:

a first transistor comprising a control electrode connected to a first node, an input electrode connected to a second node and an output electrode connected to a third node;

a second transistor comprising a control electrode which receives a data write gate signal, an input electrode which receives the data voltage and an output electrode connected to a fourth node;

a third transistor comprising a control electrode which receives a compensation gate signal, an input electrode connected to the first node and an output electrode connected to the third node;

a fourth transistor comprising a control electrode which receives a data initialization gate signal, an input electrode which receives the initialization voltage and an output electrode connected to the first node;

a fifth transistor comprising a control electrode which receives the compensation gate signal, an input electrode which receives a reference voltage and an output electrode connected to the fourth node;

a sixth transistor comprising a control electrode which receives an emission signal, an input electrode connected to the third node and an output electrode connected to an anode electrode of the light emitting element; and a seventh transistor comprising a control electrode which receives a light emitting element initialization gate signal, an input electrode which receives the initialization voltage and an output electrode connected to the anode electrode of the light emitting element, wherein the driving switching element is the first transistor, wherein the data write switching element is the second transistor, and wherein the light emitting element initialization switching element is the seventh transistor.

3. The pixel of claim 2, wherein the pixel further comprises:

a storage capacitor including a first electrode connected to the first node and a second electrode connected to the fourth node; and a hold capacitor including a first electrode which receives a predetermined voltage and a second electrode connected to the fourth node.

4. The pixel of claim 3, wherein when a voltage change amount of the control electrode of the first transistor is ΔVGT1 where a voltage of the control electrode is changed by the boosting capacitor in a bias period, a capacitance of the storage capacitor is CST, a capacitance of the hold capacitor is CHOLD, a capacitance of the boosting capacitor is CBOOST, a capacitance of the first transistor T1 is CGT1, a high level of the light emitting element initialization gate signal is VGH and a low level of the light emitting element initialization gate signal is VGL, the voltage change amount is determined by following Equation:

$$\Delta VGT1 = \frac{CBOOST}{CST + (CHOLD \,//\, CGT1) + CBOOST} \times (VGH - VGL),$$

// means a parallel connection of capacitances.

5. The pixel of claim 2, wherein the data write gate signal has an inactive level in a bias period, wherein the compensation gate signal has an inactive level in the bias period, wherein the data initialization gate signal has an inactive level in the bias period, and wherein the light emitting element initialization gate signal has an active level in the bias period.

6. The pixel of claim 5, wherein the data write gate signal maintains the inactive level in the bias period, wherein the compensation gate signal maintains the inactive level in the bias period, wherein the data initialization gate signal maintains the inactive level in the bias period, and wherein the light emitting element initialization gate signal has a plurality of pulses having the active level in the bias period.

7. The pixel of claim 2, wherein the pixel further comprises an eighth transistor comprising a control electrode which receives a first emission signal, an input electrode which receives a predetermined voltage and an output electrode connected to the second node, and wherein the emission signal is a second emission signal.

8. The pixel of claim 7, wherein a width of a high duration of the first emission signal in a data writing period when the data voltage is applied to the pixel is different from a width of a high duration of the first emission signal in a self scan period when the data voltage is not written to the pixel and the light emitting element is turned on.

9. The pixel of claim 1, wherein the first electrode of the boosting capacitor is disposed at a first layer connected to the control electrode of the light emitting element initialization switching element, and wherein the second electrode of the boosting capacitor is connected to the output electrode of the data write switching element and disposed at a second layer different from the first layer.

10. A pixel comprising:

a light emitting element;

a driving switching element which applies a driving current to the light emitting element;

a light emitting element initialization switching element which applies an initialization voltage to a first electrode of the light emitting element; and a boosting capacitor including a first electrode connected to a control electrode of the light emitting element initialization switching element and a second electrode directly connected to a control electrode of the driving switching element.

11. The pixel of claim 10, wherein the pixel further comprises:

a first transistor comprising a control electrode connected to a first node, an input electrode connected to a second node and an output electrode connected to a third node;

a second transistor comprising a control electrode which receives a data write gate signal, an input electrode which receives the data voltage and an output electrode connected to a fourth node;

a third transistor comprising a control electrode which receives a compensation gate signal, an input electrode connected to the first node and an output electrode connected to the third node;

a fourth transistor comprising a control electrode which receives a data initialization gate signal, an input electrode which receives the initialization voltage and an output electrode connected to the first node;

a fifth transistor comprising a control electrode which receives the compensation gate signal, an input electrode which receives a reference voltage and an output electrode connected to the fourth node;

a sixth transistor comprising a control electrode which receives an emission signal, an input electrode connected to the third node and an output electrode connected to an anode electrode of the light emitting element; and a seventh transistor comprising a control electrode which receives a light emitting element initialization gate signal, an input electrode which receives the initialization voltage and an output electrode connected to the anode electrode of the light emitting element, wherein the driving switching element is the first transistor, and wherein the light emitting element initialization switching element is the seventh transistor.

12. The pixel of claim 11, wherein the pixel further comprises:

a storage capacitor including a first electrode connected to the first node and a second electrode connected to the fourth node; and a hold capacitor including a first electrode which receives a predetermined voltage and a second electrode connected to the fourth node.

13. The pixel of claim 12, wherein when a voltage change amount of the control electrode of the first transistor is ΔVGT1 where a voltage of the control electrode is changed by the boosting capacitor in a bias period, a capacitance of the storage capacitor is CST, a capacitance of the hold capacitor is CHOLD, a capacitance of the boosting capacitor is CBOOST, a capacitance of the first transistor T1 is CGT1, a high level of the light emitting element initialization gate signal is VGH and a low level of the light emitting element initialization gate signal is VGL, the voltage change amount is determined by following Equation:

$$\Delta VGT1 = \frac{CBOOST}{(CST\ //\ CHOLD) + CGT1 + CBOOST} \times (VGH - VGL),$$

// means a parallel connection of capacitances.

14. The pixel of claim 11, wherein the pixel further comprises an eighth transistor including a control electrode which receives a first emission signal, an input electrode which receives a predetermined voltage and an output electrode connected to the second node, and wherein the emission signal is a second emission signal.

15. The pixel of claim 10, wherein the first electrode of the boosting capacitor is disposed at a first layer connected to the control electrode of the light emitting element initialization switching element, and wherein the second electrode of the boosting capacitor is connected to the control electrode of the driving switching element and disposed at a second layer different from the first layer.

16. A display apparatus comprising:

a display panel including a pixel;

a gate driver which provides a gate signal to the pixel;

a data driver which provides a data voltage to the pixel; and an emission driver which provides an emission signal to the pixel, wherein the pixel comprises:

a light emitting element;

a data write switching element which receives the data voltage;

a driving switching element which applies a driving current to the light emitting element based on the data voltage;

a light emitting element initialization switching element which applies an initialization voltage to a first electrode of the light emitting element; and a boosting capacitor including a first electrode directly connected to a control electrode of the light emitting element initialization switching element and a second electrode directly connected to an output electrode of the data write switching element.

17. The display apparatus of claim 16, wherein the gate driver comprises:

a normal gate driver which generates a gate signal not applied to the light emitting element initialization switching element; and a bias gate driver which generates a gate signal applied to the light emitting element initialization switching element.

18. The display apparatus of claim 17, wherein a stage of the normal gate driver is configured to receive a first clock signal, a gate high voltage and a gate low voltage, and wherein a stage of the bias gate driver is configured to receive a second clock signal different from the first clock signal, the gate high voltage and the gate low voltage.

19. The display apparatus of claim 18, wherein a high level of the first clock signal is equal to the gate high voltage, and wherein a high level of the second clock signal is greater than the gate high voltage.

20. The display apparatus of claim 17, wherein a stage of the normal gate driver is configured to receive a clock signal, a first gate high voltage and a first gate low voltage, and wherein a stage of the bias gate driver is configured to receive the clock signal, a second gate high voltage different from the first gate high voltage, and a second gate low voltage different from the first gate low voltage.

* * * * *